US012616909B2

(12) United States Patent
Christensen et al.

(10) Patent No.: US 12,616,909 B2
(45) Date of Patent: May 5, 2026

(54) MODEL VEHICLE WING MOUNTING SYSTEM

(71) Applicant: TRAXXAS, L.P., McKinney, TX (US)

(72) Inventors: Casey Christen Jens Christensen, McKinney, TX (US); Otto Karl Allmendinger, Rowlett, TX (US); Jory Sprowl, Howe, TX (US); Skylar Hagler, Anna, TX (US); Adam Cole Ewing, McKinney, TX (US)

(73) Assignee: TRAXXAS, L.P., McKinney, TX (US)

( * ) Notice: Subject to any disclaimer, the term of this patent is extended or adjusted under 35 U.S.C. 154(b) by 103 days.

(21) Appl. No.: 18/376,973

(22) Filed: Oct. 5, 2023

(65) Prior Publication Data

US 2024/0115965 A1 Apr. 11, 2024

Related U.S. Application Data

(60) Provisional application No. 63/414,083, filed on Oct. 7, 2022.

(51) Int. Cl.
*A63H 17/26* (2006.01)

(52) U.S. Cl.
CPC ..... *A63H 17/262* (2013.01)

(58) Field of Classification Search
CPC ..... A63H 17/262
USPC ..... 446/471
See application file for complete search history.

(56) References Cited

U.S. PATENT DOCUMENTS

| | | | | |
|---|---|---|---|---|
| 3,222,817 | A * | 12/1965 | Brandstetter | A63H 27/00 446/62 |
| 3,839,818 | A * | 10/1974 | Heggedal | A63H 27/007 446/68 |
| 4,629,240 | A * | 12/1986 | Dornier | B62D 35/007 296/180.5 |
| 2002/0067049 | A1* | 6/2002 | Pettey | B62D 35/007 296/180.1 |
| 2011/0176861 | A1* | 7/2011 | Nakayama | A63H 17/262 403/122 |
| 2011/0177755 | A1* | 7/2011 | Nakayama | A63H 17/262 446/470 |
| 2018/0126290 | A1* | 5/2018 | Hodge | A63H 17/262 |
| 2025/0144537 | A1* | 5/2025 | Kamiyama | A63H 17/266 |

OTHER PUBLICATIONS

Bumper, rear / bumper mount (fits 4WD rustler)(for LED light kit installation), Traxxas Webpage [online], [Site visited Jan. 30, 2024], URL: https://traxxas.com/products/parts/6737X (Year: 2024).

* cited by examiner

*Primary Examiner* — Kimberly S Berona
(74) *Attorney, Agent, or Firm* — Daryl R. Wright; Greg Carr

(57) ABSTRACT

A model vehicle wing mounting system for a model vehicle including a wing support, a deformable mount, and a pivotal mount is provided. The wing support is rotatively attached to the model vehicle chassis at a first location via the pivotal mount. The wing supported is deformably attached to the model vehicle chassis at a second location via the deformable mount. The wing is fixedly attached to the wing support. The pivotal mount may be a pinned hinge or a flexible hinge. The deformable mount may be an elongated oval configuration or rubber. The wing mounting system provides a measure of shock absorption for the model vehicle wing.

20 Claims, 3 Drawing Sheets

MODEL VEHICLE WING MOUNTING SYSTEM

RELATED APPLICATIONS

This application (claims the benefit of a related U.S. Provisional Application Ser. No. 63/414,083 filed Oct. 7, 2022, entitled "MODEL VEHICLE WING MOUNT IMPACT LOOP," to Casey Christen Jens Christensen et al., the disclosure of which is incorporated by reference herein in its entirety.

BACKGROUND

The following descriptions and examples are not admitted to be prior art by virtue of their inclusion in this section.

Radio Controlled (RC) model vehicles have a long history as an enjoyable hobby for people of all ages. The variety of RC model vehicles range from cheap dollar store model vehicles that may only last a few times before breaking, to more advanced hobby grade model vehicles. Hobby grade model vehicles are marketed to older operators (typically ages 14+) and typically involve being able to replace parts that break during heavy use. In order to avoid breakage and allow operators longer and more extreme run-times, hobby grade model vehicles use design and material selection to ensure robustness and durability.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with one exemplary embodiment, a model vehicle comprising a model vehicle wing mounting system is provided. The model vehicle wing mounting system comprises a wing support, a deformable mount, and a pivotal mount. Wherein the wing support is pivotally coupled at a first chassis location of a model vehicle chassis via the pivotal mount and the wing support is deformably coupled at a second chassis location of the model vehicle chassis via the deformable mount. Further, the wing support is fixedly coupled to a model vehicle wing.

In accordance with another exemplary embodiment, a model vehicle wing mounting system is provided. The model vehicle wing mounting system comprising a wing support, a deformable mount, and a pivotal mount. Wherein the wing support is configured to be pivotally coupled at a first chassis location of a model vehicle chassis and the wing support is configured to be deformably coupled at a second chassis location of the model vehicle chassis via the deformable mount. In addition, the wing support is configured to fixedly couple to a model vehicle wing.

In accordance with yet another exemplary embodiment, a model vehicle comprising a model vehicle wing mounting system is provided. The model vehicle wing mounting system comprising a wing support, a deformable mount, and a pivotal mount. Wherein the wing support is pivotally coupled at a first chassis location of a model vehicle chassis and the wing support is deformably coupled at a second chassis location of the model vehicle chassis via the deformable mount. In addition, wherein the wing support is fixedly coupled to a model vehicle wing.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following specification, numerous specific details are set forth to provide a thorough understanding of embodiments of the present disclosure. However, those skilled in the art will appreciate that the embodiments may be practiced without such specific details. In other instances, well-known elements have been illustrated in schematic or block diagram form in order not to obscure embodiments of the present disclosure in unnecessary detail.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment.

In the hobby of racing radio controlled or remote controlled (RC) model vehicles, many techniques and advantages found in full size automotive and off-road racing are translated for use on scale versions of the model vehicles. One such advantage is the use of aerodynamics, such as rear wings and spoilers for example, to increase traction and downforce as the model vehicles are run at speed. However, in the world of scale off-road model vehicle racing, the model vehicles often crash and face a harsher racing environment than their full-sized counterparts.

Accordingly, model vehicles are typically designed for robustness via material selection and design choices. In a high-performance off-road racing model vehicle, a rear mounted wing extending either behind or above a model vehicle body is particularly vulnerable to breaking off from the rest of the model vehicle. Repair takes valuable race or practice time away from the operator and can interfere with the fun of operating an off-road model vehicle.

Figure 1:
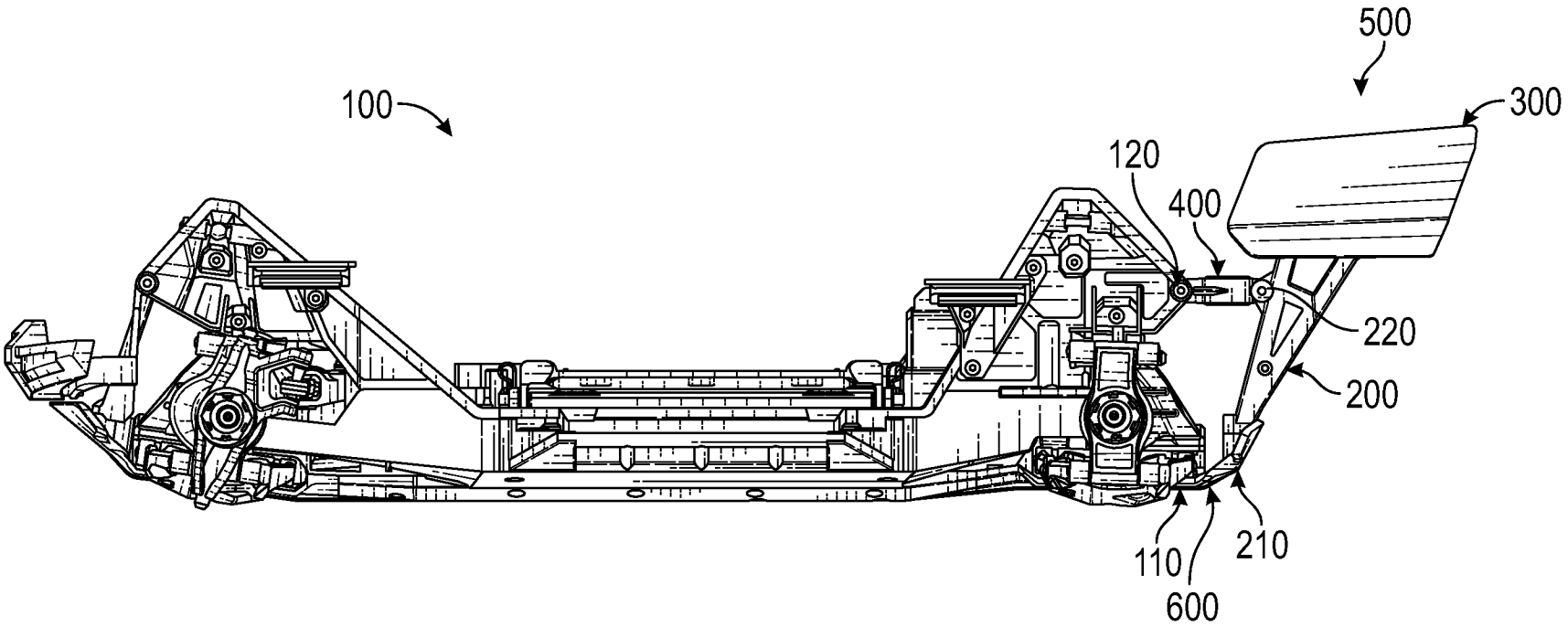
FIG. 1 is a left-side view of a model vehicle chassis containing a model vehicle wing mounting system according to an embodiment of the present disclosure.
Figure 2:
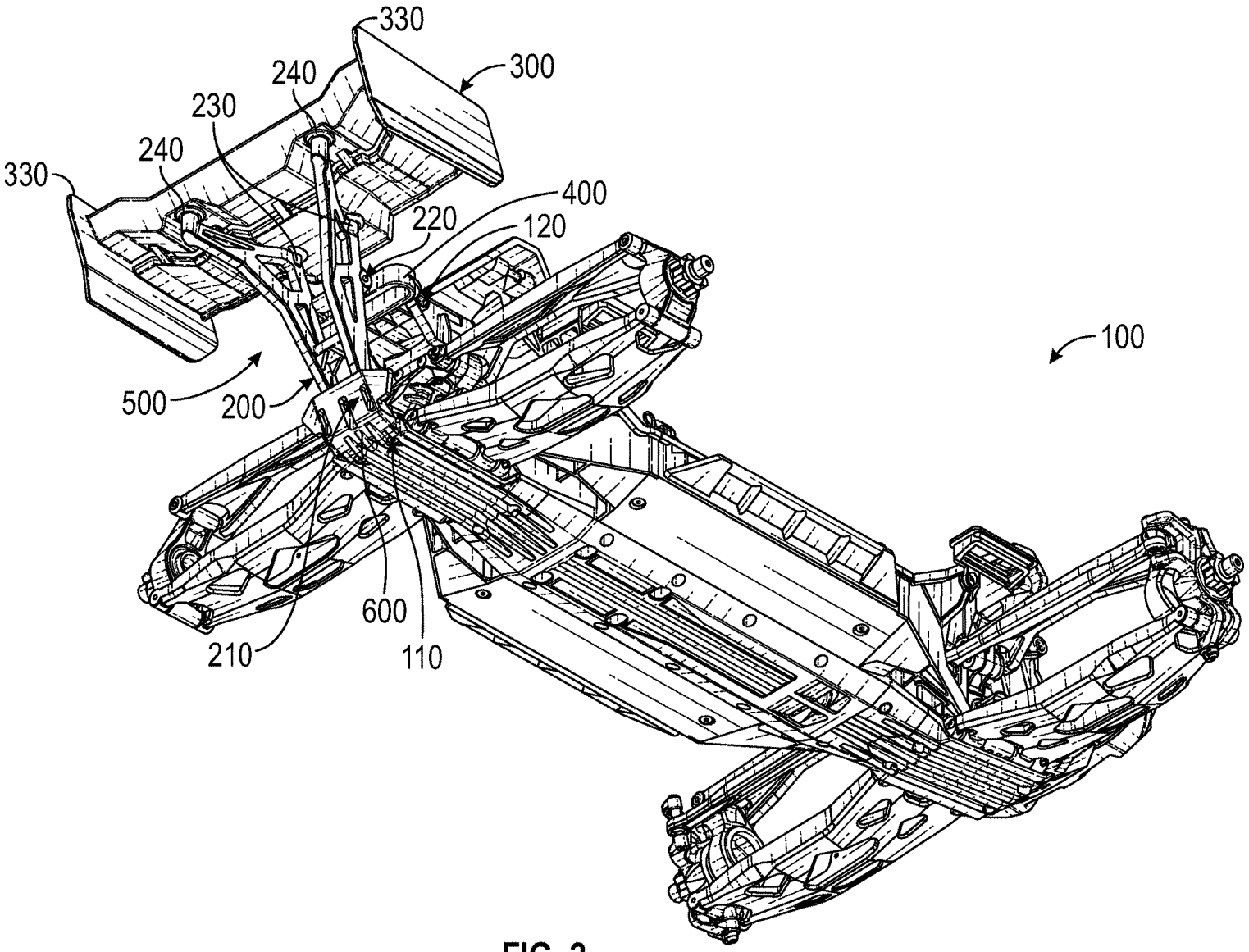
FIG. 2 is a lower, right-side, rear perspective view of the model vehicle chassis of FIG. 1, according to an embodiment of the present disclosure.
Figure 3:
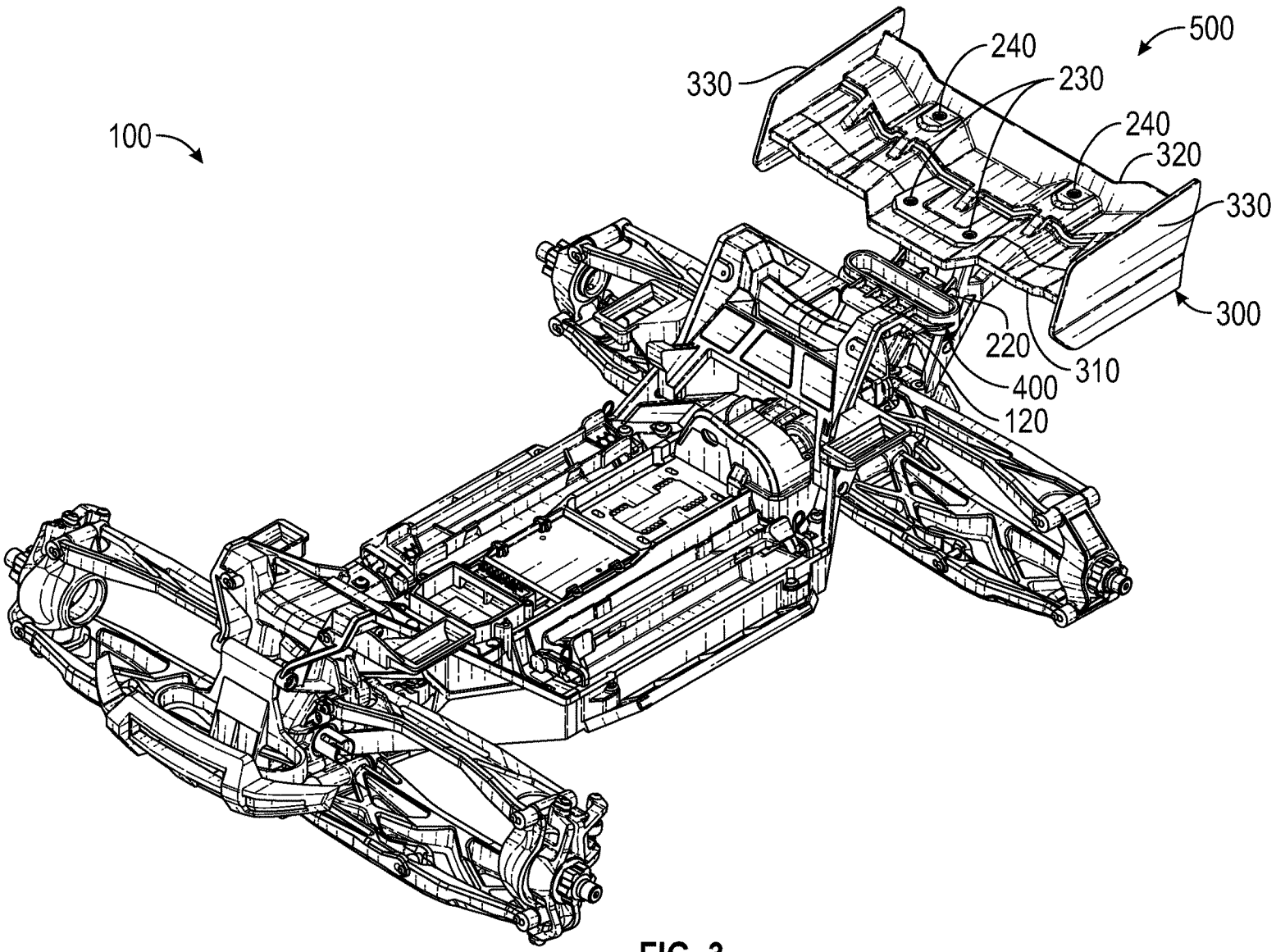
FIG. 3 is an upper, left-side, front perspective view of the model vehicle chassis of FIG. 1, according to an embodiment of the present disclosure.

In an exemplary embodiment referring generally to FIGS. 1-3, a model vehicle chassis 100 from a model vehicle (not shown) is shown with a high mounted rear wing 300 using a wing mounting system 500 of the current disclosure. The wing mounting system comprises a wing support 200, deformable mount 400, and a pivotal mount 600.

Overall, this produces a wing 300 that is pivotally coupled to the model vehicle chassis 100 and provides a degree of rotation about the pivotal mount 600. When the wing mounting system 500 rotates about the pivotal mount 600, the deformable mount 400 is elastically deformed. A degree of shock absorption from impact or strikes to the wing 300 during more extreme operation of the model vehicle may be facilitated or mitigated due to the elastic movement of the wing mounting system 500.

In this particular embodiment, the pivotal mount 600 is fixedly attached to a lower location 210 of the wing support 200. In addition, the pivotal mount 600 is fixedly attached to the model vehicle chassis 100 at first location 110. While the pivotal mount 600 is shown as a flexible hinge, a pinned hinge among other ways to hingedly couple the wing support 200 to the model vehicle chassis 100 may be used.

In the event a pinned hinge is used for the pivotal mount 600, both the lower location 210 of the wing support 200 and the first chassis location 110 of the model vehicle chassis 100 would rotate about a common pin.

The wing support 200 at an upper location 220 is deformably coupled to the model vehicle chassis 100 at a second chassis location 120 via the deformable mount 400. The deformable mount 400 is elastically deformable forwards and backwards relative to the direction of the model vehicle chassis 100 (i.e., bringing the upper location 220 closer and farther away from the second chassis location 120 in a slightly arcing manner about the pivotal mount 600).

The deformable mount 400 may be elastically deformable due to material selection and/or design configuration. In this case, the deformable mount 400 is made from a plastic or rubber material in the shape of an elongated oval. The elongated oval is then able to widen and narrow as the deformable mount 400 elastically deforms. Other shapes and other materials may be substituted as applicable by a person of skill in the art without departing from the scope and coverage of the claims.

In this exemplary embodiment, the deformable mount 400 may be pivotally coupled to the wing support 200 at the upper location 220 and/or the model vehicle chassis 100 at the second chassis location 120 via pinned hinges. This may allow for slight rotation or movement in the deformable mount 400 relative to one or both of the wing support 200 and/or the model vehicle chassis 100.

Of course, many different configurations of model vehicle wings 300 may be used on a model vehicle. The current illustrations show a wing 300 with a first level wing 310, a second level wing 320, and two side stabilizers 330 coupled to both the first level wing 310 and the second level wing 320. The use of different configurations of wings 300 may be due to aesthetic and/or aerodynamic reasons.

The wing 300 is fixedly coupled to the top of the wing support 200 in multiple places. In this embodiment, the first level wing 310 is fixedly coupled to the top of the wing support 200 at locations 230. While two locations 230 are shown, more or less may be used depending on physical demands of the application and/or aesthetic reasons.

The second level wing 320 may be fixedly coupled to the top of the wing support 200 at locations 240. As with locations 230, two locations 240 are shown, but more or less may be used depending on physical demands of the application and/or aesthetic reasons.

Although only a few example embodiments have been described in detail above, those skilled in the art will readily appreciate that a wide range of variations, modifications, changes, and substitutions are contemplated in the foregoing disclosure and, in some instances, some features of the present disclosure may be employed without a corresponding use of the other features.

It is the express intention of the applicant not to invoke 35 U.S.C. § 112, paragraph 6 for any limitations of any of the claims herein, except for those in which the claim expressly uses the words 'means for' together with an associated function.

We claim:

1. A model vehicle comprising a model vehicle wing mounting system, comprising;
- a wing support;
- a deformable mount;
- a pivotal mount;
- wherein the wing support is pivotally coupled at a first chassis location of a model vehicle chassis via the pivotal mount;
- wherein the wing support is deformably coupled at a second chassis location of the model vehicle chassis via the deformable mount; and
- wherein the wing support is fixedly coupled to a model vehicle wing.

2. The model vehicle according to claim 1 wherein the pivotal mount is a flexible hinge.

3. The model vehicle according to claim 1 wherein the pivotal mount is a pinned hinge.

4. The model vehicle according to claim 1 wherein the deformable mount is a wide oval comprising a deformable material.

5. The model vehicle according to claim 4 wherein the deformable material is plastic.

6. The model vehicle according to claim 4 wherein the deformable material is rubber.

7. The model vehicle according to claim 1 wherein the deformable mount is pivotally coupled to the wing support.

8. The model vehicle according to claim 1 wherein the pivotal mount facilitates rotation around a pivot axis that is parallel to the horizontal direction and perpendicular to a longitudinal axis of the model vehicle.

9. The model vehicle according to claim 1, wherein the model vehicle wing is a multi-level wing wherein each level is fixedly coupled to the wing support.

10. A model vehicle wing mounting system, comprising:
- a wing support;
- a deformable mount;
- a pivotal mount;
- wherein the wing support is configured to be pivotally coupled at a first chassis location of a model vehicle chassis via a pivotal mount;
- wherein the wing support is configured to be deformably coupled at a second chassis location of the model vehicle chassis via the deformable mount; and
- wherein the wing support is configured to fixedly couple to a model vehicle wing.

11. The model vehicle wing mounting system according to claim 10, wherein the deformable mount is located on the wing support above the pivotal mount.

12. The model vehicle wing mounting system according to claim 10, wherein the deformable mount is rotatively coupled to the wing support.

13. The model vehicle wing mounting system according to claim 10, wherein the pivotal mount is a flexible hinge.

14. The model vehicle wing mounting system according to claim 10, wherein the deformable mount is rotatively coupled via a pinned hinge.

15. A model vehicle comprising a model vehicle wing mounting system, comprising:

a wing support;

a deformable mount comprising a deformable material in a shape of an elongated oval;

a pivotal mount;

wherein the wing support is pivotally coupled at a first chassis location of a model vehicle chassis via the pivotal mount;

wherein the wing support is deformably coupled at a second chassis location of the model vehicle chassis via the deformable mount; and wherein the wing support is fixedly coupled to a model vehicle wing.

16. The model vehicle according to claim 15 wherein the pivotal mount is a flexible hinge.

17. The model vehicle according to claim 15 wherein the pivotal mount is a pinned connection.

18. The model vehicle according to claim 15 wherein the deformable mount is rotatively coupled at the second chassis location via a pinned connection.

19. The model vehicle according to claim 15 wherein the deformable material is rubber.

20. The model vehicle according to claim 15 wherein the deformable material is plastic.

* * * * *